United States Patent [19]

Ryder

[11] 4,262,372

[45] Apr. 21, 1981

[54] DISINFECTION SYSTEM FOR A PRESSURIZED FLUSH TOILET IN A RECREATIONAL VEHICLE OR THE LIKE

[76] Inventor: Donald F. Ryder, R.R. 1, Box 212B, Barnhart, Mo. 63012

[21] Appl. No.: 45,838

[22] Filed: Jun. 5, 1979

[51] Int. Cl.[3] ..... E03D 9/02

[52] U.S. Cl. ..... 4/222; 4/223; 4/224

[58] Field of Search ..... 222/630; 4/222, 223, 4/224, 225, 227, 231

[56] References Cited

U.S. PATENT DOCUMENTS

| | | | |
|---|---|---|---|
| 1,309,028 | 7/1919 | Goodhue | 4/223 |
| 2,886,214 | 5/1959 | Sturman | 222/630 |
| 3,118,462 | 1/1964 | Pannutti | 4/224 |
| 3,417,410 | 12/1968 | Tietema | 4/225 |
| 3,623,167 | 11/1971 | Syrenne et al. | 4/223 |
| 3,748,663 | 7/1973 | Hiller | 4/115 |
| 3,894,662 | 7/1975 | Eddy et al. | 222/630 |

FOREIGN PATENT DOCUMENTS

| | | | |
|---|---|---|---|
| 660592 | 1/1965 | Belgium | 4/223 |

*Primary Examiner*—Henry K. Artis

*Attorney, Agent, or Firm*—William B. Cunningham, Jr.

[57] ABSTRACT

A fluid or liquid powered pump system useful for injecting a liquid additive into a main stream of liquid flowing through the pump with the additive being pumped into the main liquid stream by movement of the liquid through the pump. The system has a pump body through which the main stream of liquid flows and in which the additive is injected into the liquid stream. The system further includes an unvented additive tank or bottle connected to the pump body by means of a single line.

10 Claims, 5 Drawing Figures

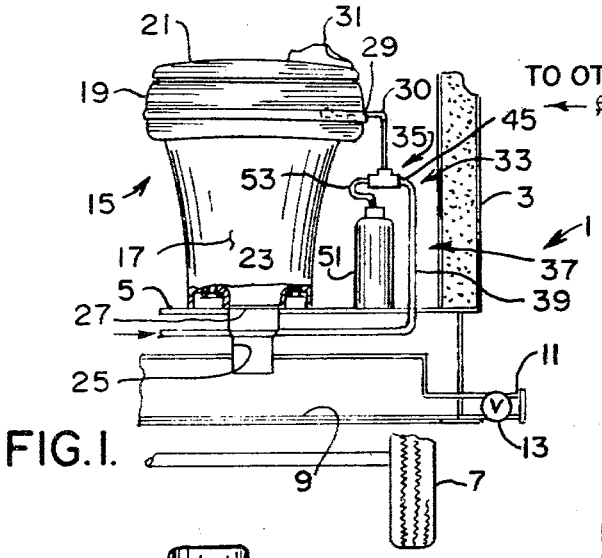
FIG. 1.
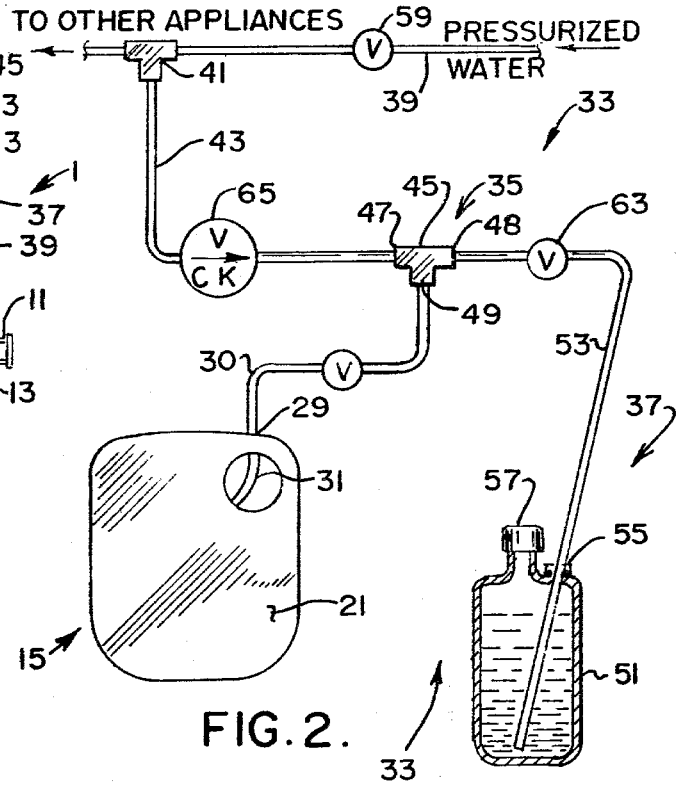
FIG. 2.
FIG. 5.
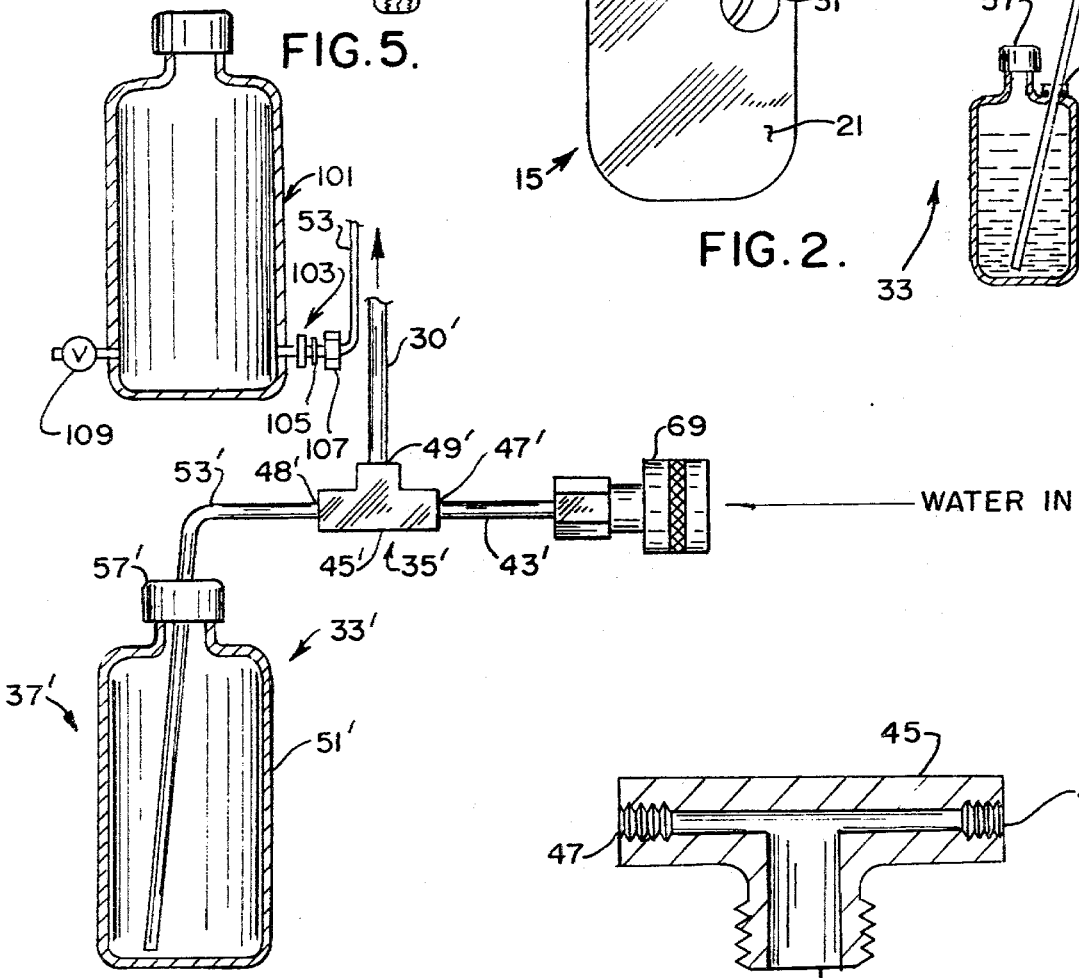
FIG. 3.
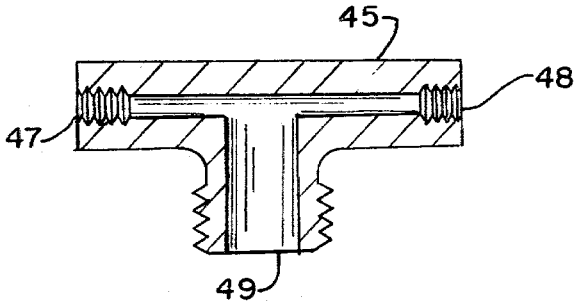
FIG. 4.

DISINFECTION SYSTEM FOR A PRESSURIZED FLUSH TOILET IN A RECREATIONAL VEHICLE OR THE LIKE

BACKGROUND OF THE INVENTION

This invention relates to a fluid or liquid powered pump, and more particularly to such a pump which is particularly useful for injecting a liquid additive into a main stream of liquid flowing through the pump. For example, this invention has particular application for injecting a liquid deoderant or disinfectant into the water lines supplying flush water to a toilet or the like.

Recreational vehicles, such as motor homes, travel trailers, campers, boats, airplanes, and the like are oftentimes or usually equipped with a toilet which when flushed dumps the waste and the flushing water into an on-board holding tank. Periodically, the holding tank is emptied of its waste, but in the meantime a considerable quantity of waste may accumulate therein. The holding tank is oftentimes installed in the floor structure of the recreational vehicle and the toilet is connected directly to the holding tank (i.e., the toilet is located directly above the holding tank). The outlet of the toilet leads down to the holding tank so that waste falls by gravity into the holding tank. A normally closed slide valve or the like is provided in the outlet of the toilet which when closed prevents odors from within the tank from entering the living areas of the recreational vehicle. Typically, no sewer trap is provided between the holding tank and the toilet.

Such recreational vehicle toilets are provided with a flush water system for the purpose of rinsing out the toilet bowl after each use and for forcing the waste out of the toilet bowl. However, these recreational vehicle toilets are quite different from conventional flush valve toilets such as are used in most U.S. residences. Many residential flush valve toilets use from 4–7 gallons of water for flushing the toilet and a considerable volume of water is retained in the toilet bowl. However, in many recreational vehicle toilets, no water is retained in the bowl and only a small quantity (e.g., from about 1 cupful to several quarts) is required to flush the toilet. This, of course, is desirable because it significantly decreases the quantity of fresh water that must be stored on-board the recreational vehicle and it reduces the required capacity of the holding tank. Typically, one flushes the recreational vehicle toilet by actuating a valve (either a foot or hand operated valve) which permits a desired quantity of flushing water to enter the toilet and which also effects the opening of the outlet valve so as to permit the waste in the toilet bowl and the flushing water to enter the holding tank. After the flushing cycle is complete, the toilet valve will close isolating the holding tank from the interior of the recreational vehicle.

Oftentimes, recreational vehicle owners will pour a liquid or granular chemical (e.g., a deodorant or disinfectant) into the holding tank by dumping the additive into the toilet bowl. Typically, this additive is added to the holding tank after it has been emptied and after a small amount of fresh water has been added thereto so as to control odors emitted from the holding tank as waste accummulates therein. It is desirable to have a relatively high concentration of the additive in the holding tank in its initial stages of use so as to effectively control odors when the holding tank is nearly empty and as it is being filled. Of course, with this method of manually adding the additive to the holding tank, the entire amount of additive is placed into the tank before any waste is accummulated therein. In many cases, however, it is desirable to add additional quantities of a deodorant or the like to the holding tank after each use of the toilet thereby to add fresh deodorant or other additives to the tank so as to further aid in controlling odors. Of course, with prior manual systems for adding the additive to the holding tank, the recreational vehicle user would be periodically required to pour small amounts of the deodorant into the holding tank via the flushing the toilet. However, many recreational vehicle users would find this task unpleasant and others would simply forget to do it. As a consequence, noxious odors are oftentimes a problem in many recreational vehicles.

While certain known mechanical systems may be adaptable to inject a quantity of a liquid additive or the like into the holding tank of a recreational vehicle each time a toilet or other appliance is used, these other systems are complicated and expensive. Also, these prior automatic additive systems typically require the use of a vented additive storage tank or bottle. Of course, in a recreational vehicle, the use of such a vented additive bottle could lead to spillage of a liquid additive within the recreational vehicle during normal use of the recreational vehicle.

Among the several objects and features of the present invention may be noted the provision of a pump useful for injecting a liquid additive into a main stream of liquid wherein the pump is of simple construction and is powered solely by the flow of the main stream of liquid through the pump;

the provision of such a pump which when installed in a recreational vehicle toilet system is automatically operated each time the toilet is flushed so as to inject a quantity of suitable additive (e.g., a deodorant or disinfectant) into the flush water so that a fresh supply of additive is added to the holding tank each time additional waste enters the holding tank;

the provision of such a pump which adds a relatively large quantity of concentrated additive to the holding tank upon the first few or initial flush cycles of the toilet and which adds progressively weaker solutions on subsequent flushes so that the majority of a desired quantity of additive is added to the holding while the holding tank is mostly empty and so that additional quantities of the additive are added each time the toilet is flushed thereby to ensure a continuing fresh source of the additive;

the provision of such a pump which may be readily incorporated in a recreational vehicle during manufacture thereof, or which may be readily installed on existing recreational vehicles (i.e., retrofitted) by the recreational vehicle owner with only simple hand tools;

the provision of such a pump which operates satisfactorily over a wide range of pressures of the liquid flowing through the pump and which will operate in any position;

the provision of such a pump in which the supply of liquid additive is not vented so as to prevent the spillage of additive from the additive tank during normal usage of the recreational vehicle in which the system is installed;

the provision of such a pump which may be readily incorporated in virtually any liquid flow system so as to inject any liquid additive into a main stream of the liquid; and the provision of such a pump which is of simple and rugged construction, which contains no moving parts, which is reliable in operation, and which is of low cost to manufacture.

Other objects and features of this invention will be in part apparent and in part pointed out hereinafter.

SUMMARY OF THE INVENTION

Briefly stated, this invention relates to a recreational vehicle or the like typically having a pressurized water line, a toilet, and a holding tank connected to the toilet for receiving and holding waste from the toilet. The water line is connected to the toilet with the latter including selectively operable means for flushing the toilet and for permitting waste from the toilet to be flushed from the toilet and to enter the holding tank. This flushing means generally includes a valve operated so as to permit water from the pressurized water line to enter the toilet. Specifically, the present invention comprises means installed in the pressurized water line for adding a liquid additive, such as a deodorant or the like, to the water entering the toilet each time the toilet is flushed. The additive means generally comprises a closed additive supply tank, an additive line connected to the pressurized water line and to the additive tank so that with the additive tank filled with an additive solution and so that upon flushing the toilet water is caused to flow through the pressurized water line to the toilet, this flowing stream of water in the pressurized water line draws a quantity of the additive solution from the additive tank and injects it into the water stream via the additive line.

In general, a liquid powered pump of this invention for injecting a liquid additive solution into a main stream of flowing liquid comprises a three port connection having a first inlet port adapted to be connected to a main source of pressurized liquid, a second inlet port and an outlet port, these ports being in communication with one another. A closed tank holding a supply of a liquid additive is provided and an additive line is sealably connected between the additive tank and the second inlet port so that with the tank being filled with a liquid additive solution and with the liquid flowing into the first port of the connection out of the second port, the main stream of liquid draws a quantity of liquid additive solution from the additive tank via the additive line and directs it into the main stream of liquid flowing from the first inlet to the outlet.

BRIEF DESCRIPTION OF THE DRAWINGS

FIG. 1 is a cross sectional view of a portion of a recreational vehicle illustrating a conventional toilet and holding tank installed in the recreational vehicle with a liquid powered pump of the present invention installed in the water supply for the toilet for automatically injecting a quantity of a liquid additive into the flush water supplied to the toilet each time the toilet is flushed;

FIG. 2 is a semi-diagrammatic view of the system supplying flush water to the toilet in a recreational vehicle or the like with a liquid additive pump of the present invention being incorporated therein;

FIG. 3 is a semi-diagrammatic view of another embodiment of the liquid powered pump of the present invention;

FIG. 4 is an enlarged longitudinal cross sectional view of the body of the liquid powered pump of the present invention; and FIG. 5 is a cross sectional view of another additive bottle or tank for use in the system of this invention.

Corresponding reference characters indicate corresponding parts throughout the several views of the drawings.

DESCRIPTION OF PREFERRED EMBODIMENTS

Referring now to the drawings, in FIG. 1 a portion of a recreational vehicle (e.g., a travel trailer or a motor home) is generally indicated by reference character 1. The recreational vehicle is shown to include an outside wall 3, a floor structure 5, and a wheel 7 for supporting the recreational vehicle. A holding tank 9 is built into floor structure 5 for holding a quantity of waste water and/or sewage. The holding tank has an outlet 11 to which an outlet hose (not shown) may be connected for draining accummulated waste from within the holding tank. A valve 13 is incorporated in outlet 11 for opening and closing the outlet. The holding capacity of holding tank 9 will vary considerably from one recreational vehicle to another, but generally these holding tanks have sufficient capacity to hold several days' waste.

As generally indicated at 15, a toilet is provided in recreational vehicle 1. This toilet is herein shown to be a conventional commercially available toilet, such as is manufactured and sold by the Thetford Corporation of Ann Arbor, Mich. Generally, the toilet comprises a base 17 made of suitable synthetic resin material (e.g., a suitable plastic material) which is secured to floor 5 of the recreational vehicle. A bowl (not illustrated) is included within base 17 for receiving waste. A seat 19 is mounted on the base and a hinged lid 21 covers the top and the base. The base has an outlet 23 therein which is sealably connected to a pipe 25 which in turn leads downwardly directly into holding tank 9. A normally closed slide valve 27 is mounted in base 17 and closes outlet 23 and pipe 25. The toilet further includes a water line fitting 29 at the rear of the seat to which a pipe or line 30 supplying water under pressure may be connected to the toilet. A valve 31 is provided in the toilet for selectively admitting a relatively small quantity of water so as to flush waste from within the toilet bowl into the holding tank and so as to rinse the inside of the bowl. As is conventional, a linkage (not shown) interconnects the actuation handle of valve 31 and valve 27 so as to simultaneously open valve 27 upon initiating a flush cycle of the tiolet thereby to permit waste water to enter the toilet and so as to permit the waste water and the waste to be discharged or flushed from the toilet into the holding tank. It will be understood that in certain toilet designs, the slide valve may remain open for a time sufficient so as to complete a flush cycle of the toilet even after the actuation handle of valve 31 has been released. After the flush cycle is completed, the valve 27 will close thereby to prevent noxious odors and the like from entering the interior of the recreational vehicle from within holding tank 9. Thus far described, recreational vehicle 1 and toilet 15 installed therein are conventional.

In accordance with this invention, recreational vehicle 1 and toilet 15 are provided with means, as generally indicated at 33, for automatically injecting a quantity of a liquid additive solution, such as a deodorizer, a disinfectant, or a cleanser, into the main stream of water entering the toilet via fitting 29 each time the toilet is flushed. In general, means 33 includes a pump 35 which is powered by the flow of the main stream of water flowing to the toilet and further includes a supply 37 of the additive.

As is conventional, recreational vehicle 1 includes a pressurized water system including a main line 39 (see FIG. 2) leading from a supply to toilet 15 and/or to other appliances (e.g., a shower or sink). As shown in FIG. 2, a tee 41 is provided in main water line 39 and a toilet supply line 43 extends therefrom for connection to pump 35. In FIG. 2, main line 39 is shown to continue past tee 41 for connection to other appliances.

Pump 35 of this invention is shown to include a tee 45 having a first inlet port 47 to which toilet supply line 43 is connected, a second inlet port 48 to which additive supply means 37 is connected, and an outlet port 49. This last mentioned outlet port is adapted to be connected to water fitting 29 on toilet 15 via water supply line 30. Specifically, additive supply means 37 is shown to comprise a closed (i.e., unvented) tank or bottle 51 holding, for example, a supply of a concentrated additive. In FIG. 2, tee 45 is shown to be installed in line 30 downstream from water connection 29 on toilet 15. An additive supply line 53 connects ports 48 of tee 45 to tank 51 with this additive supply line extending, at least in part, into the interior of the tank where its open end is in communication with the liquid additive contained within the tank. As indicated at 55, tank 51 may have a threaded (or other suitable quick disconnect) fitting enabling additive line 53 to be readily coupled to and uncoupled from the tank. Further, tank 51 is shown to have a removable cap 57 for permitting the tank to be filled with an additional supply of concentrated additive.

Referring now to FIG. 4, the construction of tee 45 is shown in greater detail. The tee is preferably of one-piece construction and may be made of suitable metal alloy (e.g., brass), synthetic resin (PVC plastic), or glass. Preferably, inlet port 47 and additive port 48 are coaxial (i.e., they are generally in line with one another) and outlet port 49 is generally perpendicular to the axis of ports 47 and 48. In general, optimum operation of pump 35 results when ports 47 and 48 are smaller than outlet port 49. Specifically, it has been found that optimum operation of the pump results if the flow area of ports 47 and 48 is only about one-sixth (1/6) the flow area of port 49. It will be appreciated, however, that flow area ratios other than the above-noted preferred ratio will permit satisfactory operation of the pump of this invention.

As will be appreciated, toilet 15 may be flushed a predetermined number of times before holding tank 9 becomes filled with waste and must be emptied. Of course, the number of flushes required to fill the holding tank will vary considerably depending on the capacity of the holding tank and the quantity of flush water utilized on each flush of the toilet. With holding tank 9 empty (i.e., preferably with a small quantity of fresh water therein so as to cover the bottom of the holding tank), with additive tank 51 full of a concentrated additive solution, and with system 33 connected to toilet 15 generally as shown in FIG. 2, operation of toilet 15 and system 35 of the present invention will now be explained. The user of toilet 15 actuates valve 31 in the conventional manner so as to initiate a flush cycle of the toilet and to automatically inject a quantity of additive from additive bottle 51 into the flush water delivered to the toilet whereby the additive enters holding tank 9 together with the flush water and the waste from the toilet so as to at least in part deodorize or cleanse the bowl of the toilet and to further treat the waste accumulated in the holding tank. As the flush cycle is initiated, valve 31 is open thereby to permit a stream of water under pressure to flow from water supply line 39 into the toilet. As the water flows through line 43, it enters tee 45 via port 47. Initially, the majority of the main stream of water passes straight through tee 45 and enters port 48 and fills tank 51. As pressure rises within tank 51, water will be diverted from port 48 to port 49 and will enter line 30 from whence it enters the toilet. The main stream of water thus makes a substantially right angle turn as it flows from port 47 to port 49. As it makes this right angle turn, it generates a venturi effect at port 48 which in conjunction with the additive under pressure in tank 51 draws a quantity of additive solution from tank 51 and forcefully injects it into the main stream of water flowing to the toilet. The additive thus becomes mixed with the main stream of water and is carried into the toilet from whence it enters holding tank 9. The quantity of liquid additive solution injected into the water stream appears to be dependent on a number of factors including the flow area of additive line 53 and the velocity of the water flowing through line 43 and tee 45. Upon continued operation of the pump, the flow of additive from tank 51 to port 48 will momentarily cease and water together with the concentrated liquid additive solution in line 53 will be pushed back into the tank 51 thereby again replenishes water and pressurize the tank. Then, concentrate (which has now at least in part been diluted by the water drawn into tank 51) will again be drawn from the tank and injected into the main stream of water flowing through the pump body. The pump will continue to intermittently inject additive into the main stream of water flowing through the pump and to push water back into bottle 51 so long as water flows through the pump. In other words, the pump will operate continuously in a pulsating manner. For example, the pump may pulsate several times each second (e.g., 2–4 or more times a second). Of course, on each pulsation of the pump, additional water is drawn into tank 51 thereby to further diluting the concentrate within the tank. Thus, system 35 of this invention, as above described, injects the greatest concentration of liquid additive solution into the flush water flowing through the pump on the first few flush cycles of toilet 15. However, because the concentrated additive in tank 51 is not emptied but rather is only infinitely diluted, additional additive will be delivered to the flush water on each flush cycle of the toilet so that even as the holding tank becomes completely full, fresh additive will be automatically added to the water in the holding tank upon each flush cycle of the toilet. It will also be appreciated that the majority of the liquid additive will be delivered to the holding tank on the first few flushes of the toilet so that the majority of the additive will be at work in the holding tank while the holding tank is being filled with waste thereby effectively to hold down odors. When holding tank 9 is emptied, additive supply tank 51 is replenished with a new supply of concentrated additive.

As indicated at 59 and 61, shut off valves may be provided in lines 39 and 30, respectively. A throttle valve 63 is optionally provided in line 53 so as to regulate or control the flow of additive solution to pump 35. Of course, with throttle valve 63 closed, additive tank 51 is effectively isolated from line 43. Also, a one way check valve 65 may be provided in line 43 so as to prevent the flow of water through line 39 to other appliances from drawing additive from tank 51 into water line 39.

In a variation or other embodiment of system 35 of the present invention, a disposable additive tank or bottle is utilized in place of the bottle 51 shown in FIG. 1, this disposable bottle containing a predetermined quantity of concentrated additive. More specifically, this disposable bottle would of course, having a fitting thereon similar to fitting 55 illustrated in FIG. 2 so as to enable the disposable bottle to be readily connected to additive line 53. The quantity of additive contained within the disposable bottle would be sufficient to treat one holding tank full of waste, depending on the size of tank 51. Upon emptying the holding tank, the recreational vehicle owner would then merely remove the empty disposable tank and replace it with a full one.

In another variation of the present invention, a supply of solid concentrate (as opposed to a liquid concentrate) may be placed in additive tank 51. Upon the filling of the additive tank with water and upon connecting the additive tank to additive line 53, the water will of course begin to dissolve the solid concentrate within the bottle. A sufficient volume of water is normally provided within tank 51 so that a quantity of the solid additive may be dissolved and retained within the tank. Thus, upon flushing toilet 15, a desired amount of liquid additive is available to be injected into the main water stream in pump 35 in the manner as above described. Of course, upon water entering the additive tank containing the solid concentrate material, additional amounts of the solid concentrate will dissolve in the water. Thus, this variation of the liquid powered pump of the present invention differs from the liquid concentrate system, such as above-described, in that a similar quantity (i.e., concentration) of additive will be injected into the main stream of water flowing through the pump on each flush cycle of the toilet. Of course, this assumes there is sufficient time between flush cycles of the toilet so as to permit the solid concentrate to adequately dissolve. Also, if a sufficiently large quantity of solid concentrate is provided in tank 51, one filling of the tank with solid concentrate may be adequate to treat several holding tank fulls of waste.

While various liquid and solid concentrate additives may be utilized in the liquid pump system of the present invention, it has been found that a liquid concentrate consisting of a formaldehyde and methanol solution, such as commercially available under the trade designation Biochem from Missouri Trailer Supply of Manchester, Mo. has proved to be satisfactory. Various concentrated solid toilet deodorizers and cleansers, such as may be commercially available from Boyle-Midway, Inc. New York, N.Y., under the trademark SANI-FLUSH have been used in the system of the present invention. In particular, relatively small quantities (e.g., a few ounces) of such solid concentrates will dissolve to a sufficient degree so as to provide a sufficient amount of additive as to result in effective deodorizing of the waste in the holding tank and this small quantity of solid concentrate material will dissolve sufficient slowly so as to last through many toilet flush cycles at normal toilet usage rates.

Referring now to FIG. 5, a modification of additive tank 51 is illustrated and indicated in its entirety by reference character 101. As shown, tank 101 has an inlet/outlet port or fitting 103 at its bottom. A valve 105 is incorporated in fitting 103 for throttling the flow of water to the bottle or additive to pump 35 or to shut off tank 101 from the pump. In general, this valve 105 is similar in operation to valve 63 heretofore described. A fitting or connection 107 is provided so as to permit additive line 53 to be readily coupled to or uncoupled from tank 101. A pressure release valve 109 may optionally be provided on tank 101 (or on tank 51) so as to permit pressure within the tank to be released before disconnecting the tank from line 53. These valves will also be used to drain tank 101 or 51 so concentrate can be replenished.

As above described, system 33 was herein described in conjunction with a toilet 15 installed in a recreational vehicle. However, it will be appreciated that the system of this invention could be used with any portable toilet system which utilizes a holding tank to store wastes.

Still further in accordance with the broader aspects of the present invention, it will be appreciated that the fluid or liquid powered additive injection means 33 may be readily utilized in any number of applications separate and distinct from applications in recreational vehicle toilet systems for the purpose of injecting virtually any liquid additive into a main stream of flowing liquid. As shown in FIG. 3, and as indicated generally at 33', another embodiment of the injecting system of this invention is illustrated. This second embodiment is similar to system 33 heretofore disclosed and the primed reference characters indicate parts of similar construction and operation. In particular, inlet line 43' is provided with a coupling 69 so as to permit a conventional garden hose (not shown) or the like to be readily coupled to the system, this graden hose constituting a main source of pressurized water. Tee 45' is generally similar to tee 45 heretofore described. Additive bottle 51' is shown to have a cap 57' modified to sealably receive additive line 53'. Outlet line 30' is connected to outlet port 49' of tee 45' with this outlet line constituting a discharge nozzle for spraying or squirting water which has a desired amount of liquid additive solution injected therein by pump 35'. It will be appreciated that virtually any type of liquid additive solution, such as an insecticide, fertilizer, weed killer, soap, wax, or cleaning fluid may be utilized with the system of the present invention. Of course, those skilled in the art will readily appreciate that system 33' could be incorporated in any number of spray applicator designs and that the outward appearance of the system need not be similar to that depicted in the diagrammatic views of the system as shown in FIG. 3.

It will also be understood that the liquid powered pump of this invention does not require a high pressure water supply to operate, but rather will operate throughout a range of water pressures. For example, tests have shown that the pump will operate at pressures as low as about 2.0 psig of water pressure. Of course, the tank will also operate at higher pressures.

As noted above, it is a particular feature of the system of the present invention that the additive supply bottle 51 or 51' is not to be vented to the atmosphere so as to enable the system of the present invention to withdraw liquid from the additive tank. This is particularly advantageous in that it prevents the additive from leaking from the additive bottle and thus the entire system of the present invention is a closed system.

In view of the above, it will be seen that the several objects of the invention are achieved and other advantageous results are attained.

As various changes could be made in the above constructions without departing from the scope of the invention, it is intended that all matter contained in the above description or shown in the accompanying drawings shall be interpreted as illustrative and not in a limiting sense.

I claim:

1. In a recreational vehicle or the like having a pressurized water line, a toilet, and a holding tank connected to the toilet for receiving and holding waste from the toilet, said pressurized water line being connected to said toilet, the latter including selectively operable means for flushing the toilet and for permitting waste from the toilet to enter said holding tank, said flushing means including a valve operable so as to permit water from the pressurized water line to enter the toilet, wherein the improvement comprises: means installed in said pressurized water line upstream from said valve for adding a liquid additive solution, such as a deodorant or the like, to the water entering the toilet each time the toilet is flushed, said additive means comprising a closed additive supply tank, and additive line sealably connected to said pressurized water line and to said additive tank so that with said additive tank filled with an additive solution and so that flushing said toilet causes water to flow through said pressurized water lines, said flowing water drawing a quantity of the additive solution from said additive tank and injecting it into the stream of water via said additive line and then further causing water to enter said additive tank via said additive line so that said additive solution is repeatedly injected into said supply line so long as water flows therethrough.

2. In a recreational vehicle as set forth in claim 1 wherein said additive means further comprises a three port tee in said pressurized water line downstream from the connection of said pressurized water line to said toilet, said pressurized water line being connected to a first port of said tee, said additive line being connected to a second port of said tee, and said toilet being connected to a third port of said tee.

3. In a recreational vehicle as set forth in claim 2 wherein said first and second ports are generally in line with one another and wherein said third port is generally perpendicular to said first and second ports and is located intermediate said first and second ports.

4. In a recreational vehicle as set forth in claim 3 wherein said first and second ports have a substantially smaller flow area than said third port.

5. In a recreational vehicle as set forth in claim 4 wherein the flow area of said first and second ports is preferably only approximately one-sixth (1/6) the flow area of said third port.

6. In a recreational vehicle as set forth in claim 1 wherein said pressurized water line is branched so as to supply water to other appliances as well as to said toilet, said additive system further comprising a one way check valve installed in said system between said branch and said additive tank thereby to prevent additive from the tank from being drawn into said branch.

7. In a recreational vehicle as set forth in claim 1 further including a valve in said additive line thereby to selectively open and close said additive line so that with this last-said valve closed, said additive tank is isolated from said water line.

8. In a recreational vehicle as set forth in claim 7 wherein said additive tank includes means selectively operable for releasing pressure from therewithin so as to permit said tank to be uncoupled from said additive line from said additive tank substantially without the leakage of additive solution under pressure.

9. In a recreational vehicle as set forth in claim 1 further comprising means for enabling said additive tank to be readily coupled to and uncoupled from said additive line, wherein said additive tank is disposable after use and contains a predetermined quantity of concentrated additive whereby upon connection of said additive tank to said additive line a relatively concentrated solution of said additive is injected into the flush water delivered to said toilet upon flushing of the toilet, upon operation of said means, the entrance of water into said additive tank during operation of the system serves to at least in part dilute the concentrated additive contained in the additive tank so that upon each flush cycle of the toilet a less concentrated solution of the additive is injected into the flush water and delivered into the holding tank, the quantity of concentrated additive initially contained in said additive tank being such that even after a predetermined flush cycles of said toilet and after the majority of the concentrated additive has been expelled from the additive tank and discharged into said holding tank, at least some additional additive solution is injected into the flush water upon each subsequent flushing cycle of the toilet.

10. In a recreational vehicle as set forth in claim 1 wherein said additive tank contains a supply of solid concentrate additive material which is dissolvable in water, whereby upon said additive tank being connected to said main stream of water by said additive line, water enters said additive tank and acts on said solid concentrate thereby to dissolve at least some of said solid concentrate, said dissolved concentrate thus constituting a liquid additive solution which is injected into said flush water upon flushing of said tiolet.

* * * * *